US007392743B2

(12) United States Patent
Kawaguchi et al.

(10) Patent No.: US 7,392,743 B2
(45) Date of Patent: Jul. 1, 2008

(54) THICKNESS DETECTING APPARATUS

(75) Inventors: Ryota Kawaguchi, Owariasahi (JP); Katsuyoshi Funai, Owariasahi (JP)

(73) Assignee: Hitachi-Omron Terminal Solutions, Corporation, Tokyo (JP)

( * ) Notice: Subject to any disclaimer, the term of this patent is extended or adjusted under 35 U.S.C. 154(b) by 168 days.

(21) Appl. No.: 11/226,440

(22) Filed: Sep. 15, 2005

(65) Prior Publication Data

US 2006/0055105 A1 Mar. 16, 2006

(30) Foreign Application Priority Data

Sep. 15, 2004 (JP) ..... 2004-268171

(51) Int. Cl.
*B41F 13/24* (2006.01)
*B65H 7/02* (2006.01)

(52) U.S. Cl. ..... 101/232; 271/265.04; 271/227; 271/261; 271/258.01; 271/259; 271/265.03

(58) Field of Classification Search ..... 101/232; 271/121, 111, 261–263, 265.02–265.04, 271/227–228, 258.01–259
See application file for complete search history.

(56) References Cited

U.S. PATENT DOCUMENTS 5,011,128 A * 4/1991 Tsuji ..... 271/263
5,131,648 A * 7/1992 Ito ..... 271/262
5,813,782 A * 9/1998 Mason ..... 400/636
6,666,136 B2 * 12/2003 Lee ..... 101/216
6,782,986 B2 * 8/2004 Toda et al. ..... 194/206
2004/0163558 A1 * 8/2004 Itoh et al. ..... 101/232

FOREIGN PATENT DOCUMENTS

EP 0 080 309 A2 6/1983
EP 1 5442 173 A1 11/2004
GB 1 497 181 A 1/1978
JP 05147768 A * 6/1993
JP 6-61850 U 9/1994

* cited by examiner

*Primary Examiner*—Daniel J. Colilla
*Assistant Examiner*—M. L Ferguson-Samreth
(74) *Attorney, Agent, or Firm*—McDermott Will & Emery LLP

(57) ABSTRACT

There are provided a thickness detecting apparatus which can restrain erroneous detection even though a sheet or the like overlaps with only a part of a rotary body, and, which can enhance the degree of accuracy of detection, comprising a cylindrical displaceable rotary body and a cylindrical stationary rotary body which are opposed to each other, the thickness detecting apparatus detecting a thickness of the sheet or the like to be transferred in accordance with a displacement by which the displaceable rotary body is separated from the stationary rotary body, when the sheet or the like passes through between the displaceable rotary body and the stationary rotary body, and the center of a load with which the displaceable rotary body presses the sheet or the like is biased from the center of the displaceable rotary body in one of center axial direction.

3 Claims, 11 Drawing Sheets

THICKNESS DETECTING APPARATUS

INCORPORATION BY REFERENCE

The present invention claims the benefit of priority of JP-A-2004-268171 filed Sep. 15, 2004, the disclosure of which also is entirely incorporated herein by reference.

BACKGROUND OF THE INVENTION

The present invention relates to a thickness detecting apparatus for detecting a thickness of a sheet or the like.

Conventionally, as a system for measuring a thickness of medium in order to determine whether foreign object sticks to a sheet or the like, there has been proposed such a system that a banknote is held between a stationary roller and a displaceable roller so as to detect a displacement of the displaceable roller (Refer to JP-U-6-61850).

Explanation will be made of the above-mentioned system with reference to FIG. 9 which is a partly sectioned front view. As shown, a banknote 120 is held between a displaceable roller 110 and a stationary roller 130, and a sensor 101 is arranged above the displaceable roller 110.

The displaceable roller 110 is composed of a cylindrical sheath roller 111 and a core shaft 113 and an elastic body 112 made of rubber or the like and interposed between both roller 110 and core shaft 113. The stationary roller 130 is composed of a roller 132 and a core shaft 131 inserted in the roller 132.

With this configuration, the displaceable roller is pressed against the stationary roller 130 by means of the elastic body 122 by a pressing force having a force center, uniformly thereover in the longitudinal direction of the roller 130.

The displaceable roller 110 and the stationary roller 130 are arranged in a plurality of pairs which are laid discretely in a direction widthwise of a transfer path 140 as shown in FIG. 10A which is a plan view and FIG. 10B which is a side view in order to cover the entire zone of the transfer path.

Since the width of the banknote 120 is smaller than the width of the transfer path 140, in particular, there would be caused such a case that the banknote 120 overlaps with the roller 110 only by a length which is not longer than about a half of the length of the roller as shown in FIG. 10A the displaceable roller 110 at a side end side. That is, the roller with which the banknote 120 overlaps by not longer than a half of the length thereof, would be slanted.

Meanwhile, a single sensor 110 is arranged right above of the center of one of the displaceable rollers 110 as shown in FIG. 11A which is a front view. In this case, should foreign matter 150 such as a tape sticking to the banknote 120 passes by an end part of the displaceable roller 110, only a half of a height of the foreign matter could be detected at the center of the displaceable roller 110, resulting in a problem of difficulty in detecting the foreign matter.

Thus, these days, a pair of sensors 110 are arranged respectively at opposite ends of the displaceable roller 110 as shown in FIG. 11B which is a front view, in order to improve the detection.

However, in this configuration, if the banknote 120 overlaps with the displaceable roller 110 by only a half of the length of the roller 110, as shown in FIGS. 10A and 10B, the displaceable roller 110 slants largely as a sew-saw like-manner, and resulting in a one-side lift-up condition as shown in FIG. 12A which is a front view.

Thus, the thickness of the banknote 120 would be detected by a value which is relatively larger than its actual thickness, resulting in erroneous detection of foreign matter although no foreign matter is present. Further, should setting be made such that this situation is set so as to prevent erroneous detection of foreign matter, there would be caused problems of impossible detection of foreign matter 150 having a thickness smaller than the above-mentioned one-side lift-up and of impossible detection of concave and convex features of a banknote having a thickness which is smaller than the one-side lift-up, as shown in FIG. 12B which is a front view.

Thus, in order to prevent the above-mentioned erroneous detection, data relating to a thickness of an end part of a banknote should have been discarded.

Further, in order to prevent occurrence of a one-side lift-up situation, as shown in FIG. 13 which is a plan view, it had to be better to arrange the displaceable roller 110 at a position where the medium does not overlaps by a half, but in this case, the displaceable roller 110 should be located only at the center of the transfer path, there has be caused a problem of further decreasing a possible detection area.

Meanwhile, as an another method for restraining affection by a one side lift-up, there may be considered such a method in which the width of the displaceable roller 110 is narrowed in order to reduce the volume of data which should be discarded. However, this configuration would cause the number of rollers to increase, there has been caused a problem of increasing the costs.

SUMMARY OF THE INVENTION

The present invention is device in view of the above-mentioned problems inherent to prior art, and accordingly, an object of the present invention is to provide a thickness detecting apparatus which can restrain erroneous detection in order to enhance the accuracy of detection even though a sheet or the like overlaps with only a part of a rotary body.

According to the present invention, there is provided a thickness detecting apparatus in which a cylindrical stationary rotary body and a cylindrical displaceable rotary body are opposed to each other, for detecting a thickness of a sheet or the like in accordance with a displacement by which the displaceable rotary body is displaced from the stationary rotary body when the sheet or the like passes through between both rotary bodies, characterized in that the displaceable rotary body is formed so that that a center of a load with which the displaceable rotary body presses the sheet or the like is biased in one of center-axial directions of the displaceable rotary body from the center thereof.

The biasing of the center of the load is effected by an elastic member interposed between a cylindrical sheathing and a core shaft of the displaceable rotary body. Alternatively, there may be used any suitable means such as a resilient member for externally urging the displaceable rotary body toward the stationary rotary body.

With this configuration, even though a sheet or the like passing through between both rotary bodies, overlaps with the displaceable rotary body, being not completely but one-sided, a one-side lift-up condition can be restrained since the load center is biased in a direction toward the widthwise center of a transfer path.

That is, whenever a sheet of the like overlaps with the displaceable rotary body up to the load center, no one-side lift-up condition is caused, and accordingly, a thickness of the sheet or the like may be precisely detected. Further, if a sheet or the like overlaps with the displaceable rotary body, not up to the load center, a less one-side lift up is caused since the degree of overlapping of the sheet or the like with the displaceable rotary body is less so as to restrain the one-side lift-up, thereby it is possible to restrain erroneous detection.

In a specific form of the present invention, the displaceable rotary body is composed of a cylindrical sheathing formed from a undeformable material, a shaft core inside of the former, and an elastic member therebetween, and accordingly, a center of an urging force which is applied by the elastic member and with which the inner surface of the sheathing is urged is biased from the center of the displaceable rotary body in one of center-axial directions thereof so as to bias the load center.

With this simple configuration, there may be provided a thickness detecting apparatus which may bias a load center of a displaceable rotary body toward one side, and which is small-sized and compact so as to be inexpensive.

In a further specific form of the present invention, the above-mentioned elastic member may be formed in such a way that the surface of the elastic body which makes contact with the inner surface of the sheathing may be biased in one of center axial directions.

With this configuration, the urging force may be unequally biased by moldings made of one and the same material.

In a further specific form of the present invention, the above-mentioned elastic member may be composed of plural kinds of members having different resilient forces, and those of the elastic members having higher resilient forces may be biased in one of the center axial directions.

With this configuration, the biasing of the center of the urging force may be simply made by differences among the resilient forces of the elastic members.

In a further specific form of the present invention, the above-mentioned elastic member may be formed in such a configuration that a plurality of ring-like parts adapted to make contact with the inner surface of the sheathing in a ring-like manner are ununiformly arranged in the center axial direction.

The above-mentioned ring-like parts are arranged by uniform numbers or at ununiform positions or have ununiform diameters. Alternatively, they are arranged uniformly in the center axial direction with the combination of the aforementioned matters.

With this configuration, different from such a configuration that the elastic member is formed in a gear-like shape, even though a sheet or the like makes anytime contact with the displaceable rotary body, one and the same urging force may be stably obtained since the elastic member is ring-like. Further, the center of the urging force may be biased in one of the center axial direction with a simple configuration.

In a further specific form of the present invention, the elastic member is formed so as to incorporate a displacement restraining part for restraining excessive displacement toward one end part of the elastic member on a side where the urging force in the center axial direction is weaker.

The above-mentioned displacement restraining part is formed of such as a ring-like part having a diameter smaller than the inner diameter of the sheathing, or a ring-like part having a diameter equal to the inner diameter of the sheathing and having a weak resilient force.

With this configuration, when the displaceable rotary member is positionally displaced by a sheet or the like, fluctuating from the side where the urging force is weaker may be prevented, and the side where the urging force is weaker may be prevented from being displace in excess of a thickness of the sheet or the like, thereby it is possible to prevent erroneus detection.

Thus, according to the present invention, erroneous detection may be restrained upon detection of a thickness of a sheet of the like.

Other objects, features and advantages of the invention will become apparent from the following description of the embodiments of the invention taken in conjunction with the accompanying drawings.

DESCRIPTION OF THE EMBODIMENTS

Explanation will be hereinbelow made of an embodiment of the present invention with reference to the accompanying drawings.

Figure 1:
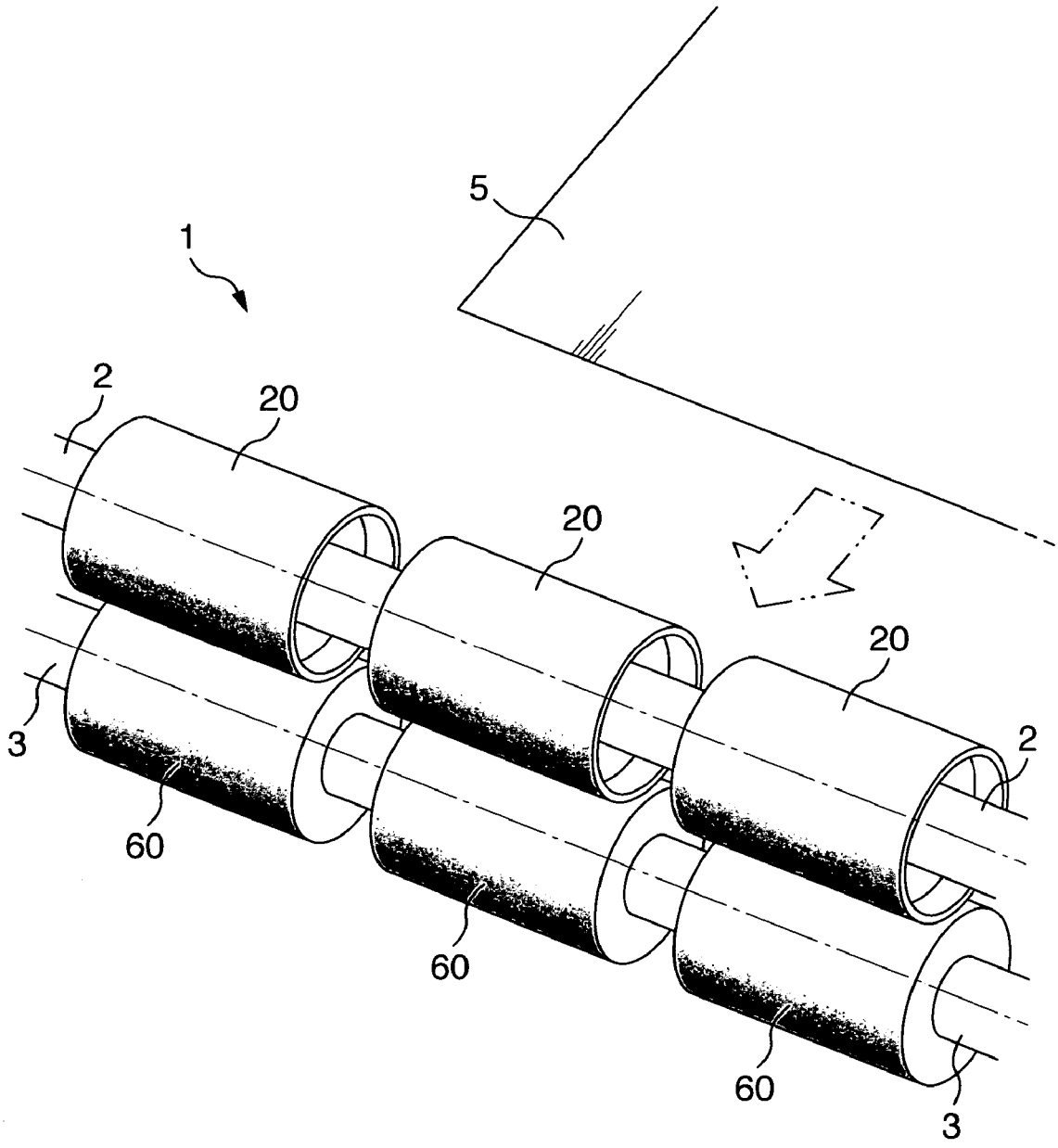
FIG. 1 is a perspective view illustrating a thickness detecting apparatus.

At first, an entire configuration of a thickness detecting apparatus will be explained with reference to FIG. 1 which is a perspective view and FIG. 2 which is a front view.

The thickness detecting apparatus 1 is composed of core shafts 2, 3 which are journalled widthwise of a transfer path in a horizontal direction, being vertically opposed to each other, a plurality of load center biasing rollers 20 and a center displaceable roller 40 which are fitted on the upper core shaft 2, a plurality of stationary rollers 60 which are fitted on the lower core shaft 3, and a plurality of sensors 10.

The center displaceable roller 40 is arranged at a center position of the core shaft 2, and the load center biasing displaceable rollers 20 in the number of four in total are symmetrically arranged, two of them being on one side and the other two of them on the other side of the center displaceable roller 40.

Above the biasing rollers 20 and the center displaceable roller 40, there are provided sensors 10 in the number of ten in total, two of them for each of the rollers being opposed to opposite ends of the roller.

The stationary rollers 60 fitted on the core shaft 3 in the number of five are arranged uniformly, and make contact with the center biasing displaceable rollers 20 and the center displaceable roller 40 arranged right above them in an original position at which no banknote 5 is transferred.

With the above-mentioned configuration, the banknote 5 to be transferred on a transfer path, passes through between the displaceable roller 20, 40 and the stationary rollers 60, and at this time, the displaceable rollers 20, 40 are raised by respective displacements which are detected by the sensors 10.

Figure 3A:
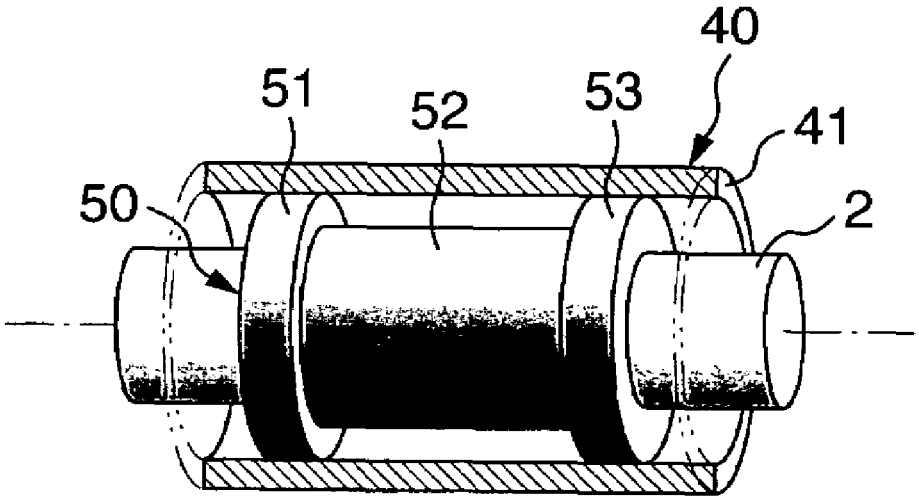
FIGS. 3A and 3B are views for explaining an internal configuration of a center displaceable roller.
Figure 3B:
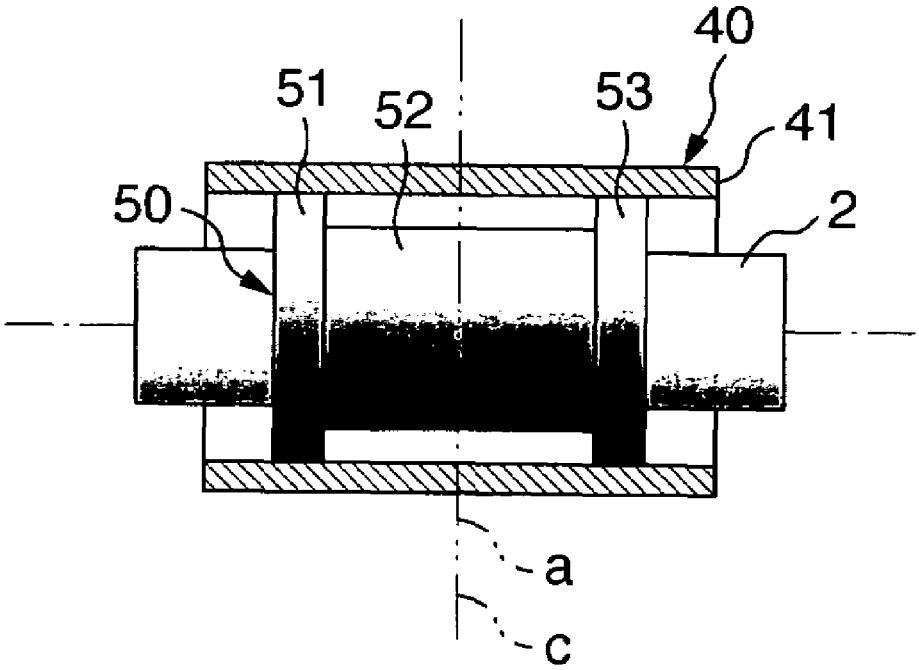

Next, explanation will be made of an internal configuration of the center displaceable roller 40 with reference to FIG. 3A which is a perspective view and FIG. 3B which is a front view.

The center displaceable roller 40 is composed of a cylindrical roller sheathing 41 formed of a metal member, and an elastic body 50 interposed between the roller sheathing 41 and the core shaft 2.

The elastic body 50 which is made of a rubber material, has a resilient force. The elastic body 50 which is integrally molded, is composed of a cylindrical body portion 52 having a diameter which is less than the inner diameter of the roller sheathing 41, and ring-like urging portions 51, 53 formed at opposite end parts of the body portion 52 and adapted to make contact with the inner periphery of the roller sheathing 41.

The ring-like urging portions 51, 53 have a diameter which are larger than the inner diameter of the roller sheathing 41, and are press-fitted in the roller sheathing 41 in order to press the latter.

Further, the above-mentioned ring-like urging portions 51, 53 are arranged symmetrically left and right, slightly inward of end faces of the roller sheathing 41 as viewed in the center axial direction.

In the above-mentioned configuration, when the banknote 5 passes through between the center displaceable 40 and the associated stationary roller 60 (Refer to FIG. 2), the elastic body 50 of the center displaceable roller 40, or in particular, the ring-like urging portions 51, 53 is deformed so that the roller sheathing 41 is raised by thicknesses of the banknote 5 and foreign matter.

Figure 2:
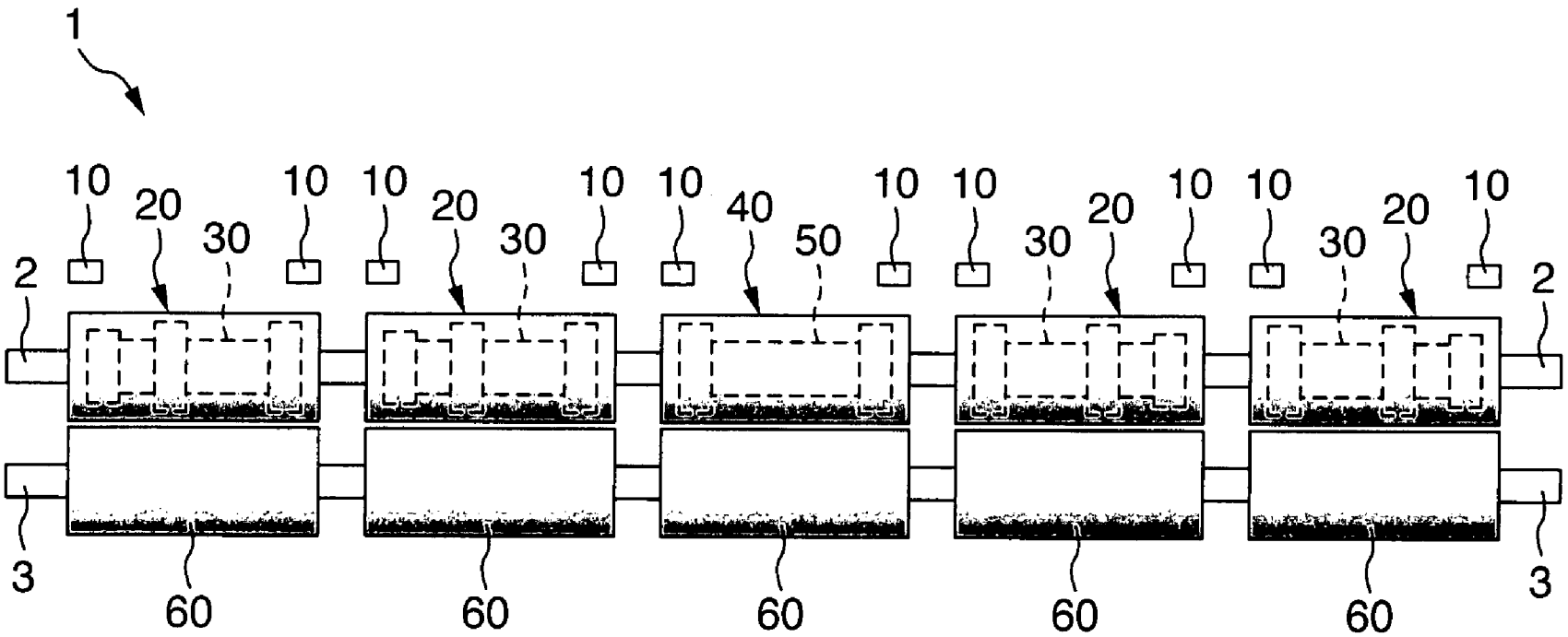
FIG. 2 is a front view illustrating a front view illustrating the thickness detecting apparatus shown in FIG. 1.

Thus, the height of the roller sheathing 41 varies, and accordingly, whether the thickness of the banknote 5 is normal or not can be detected by the sensors 10 (Refer to FIG. 2).

Since the ring-like urging portions 51, 53 are arranged symmetrically left and right, a center (refer to FIG. 3B) of an urging force (a load) of the ring-like urging portions 51, 53 of the center displaceable roller 40 is set to a center C (Refer to FIG. 3B) of the center displaceable roller 40. Accordingly, the thickness of the banknote 5 may be precisely detected in the center part of the transfer path where the banknote 5 overlaps with the roller 40 completely over the overall length of the latter, thereby it is possible to appropriately detect the detection of the thickness of the banknote 5.

Figure 4A:
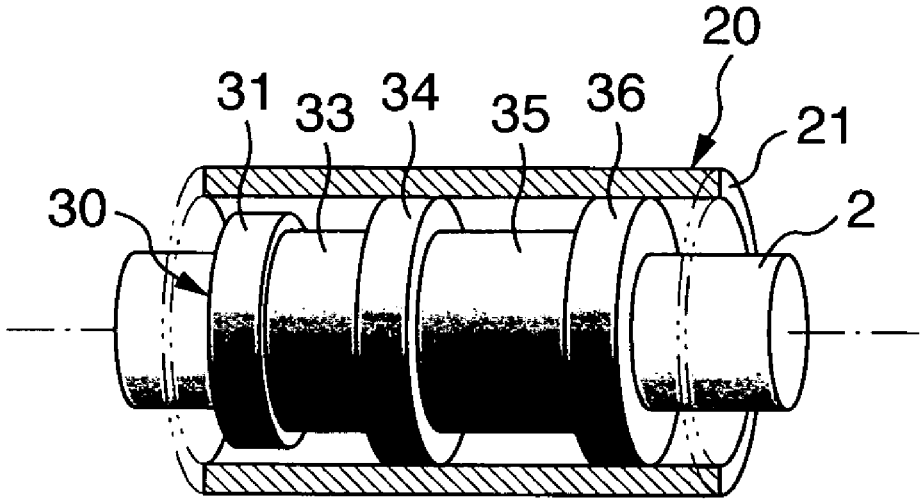
FIGS. 4A and 4B are views for explaining an internal configuration of a load center biasing displaceable roller.
Figure 4B:
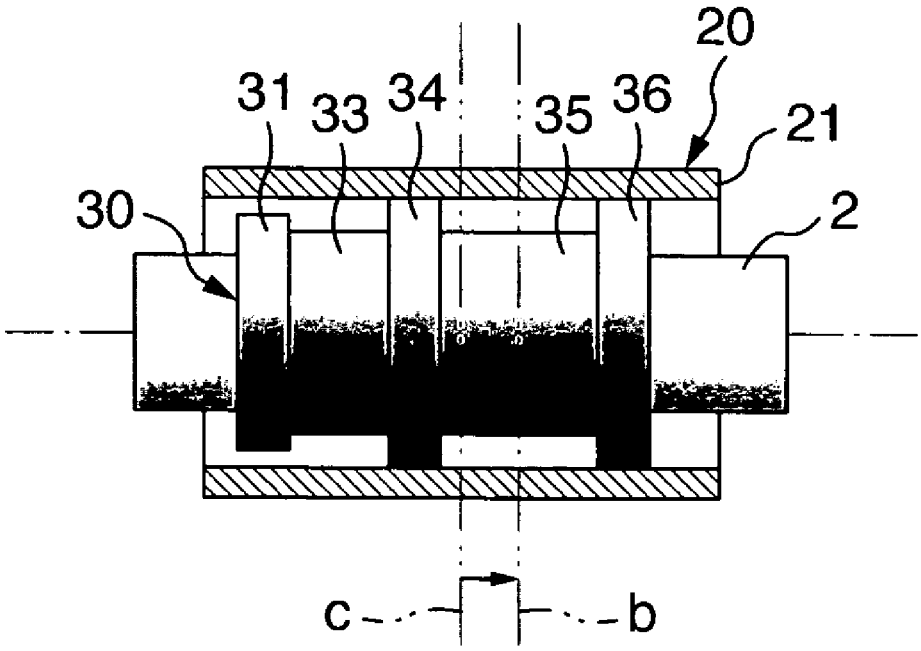

Next, explanation will be hereinbelow made of an internal configuration of the load center biasing displaceable roller 20 with reference to FIG. 4A which is a perspective view and FIG. 4B which is a front view.

The load center biasing roller 20 composed of a cylindrical roller sheathing 21 formed of a metal member, and an elastic body 30 interposed between the sheathing 21 and the core shaft 2.

The elastic body 30 which is made of a rubber material, has a resilient force. The elastic body 30 which is integrally molded, is composed of cylindrical body portions 33, 35 having a diameter smaller than the inner diameter of the roller sheathing 21, ring-like urging portions 34, 36 making contact with the inner periphery of the roller sheathing 21, and a ring-like deflection preventing portion 31 having a diameter which is smaller than the outer diameter of the ring-like urging portions 34, 36 but larger than the outer diameter of the body portions 33, 35.

Further, the ring-like urging portions 34, 36 have a diameter which is larger than the inner diameter of the roller sheathing 21, and accordingly, it is press-fitted in the roller sheathing 21 so as to press the inner periphery of the roller sheathing 21.

Further, the ring-like urging portion 36 is provided at one end (the right end in the figures) of the elastic body 30, and the ring-like urging portion 34 is provided slightly being off of the center of the elastic body 30 toward the other end side (the left side in the figures).

The ring-like deflection preventing portion 31 is provided at one end of the elastic body on the side remote from the ring-like urging portion 36, being spaced from the inner surface of the roller sheathing 21 in order to be prevented from making contact with the inner surface of the roller sheathing 21.

In the above-mentioned configuration, when the banknote 5 passes through between the load center biasing displaceable roller 20 and the stationary roller 60 (Refer to FIG. 2), the elastic body 30 (in particular, the ring-like urging portions 34, 36) is deformed, and accordingly, the roller sheathing 21 is raised by thicknesses of the banknote 5 and foreign matter.

Thus, the height of the roller sheathing 21 varies, and accordingly, whether the thickness of the banknote 5 is normal or not may be detected by the sensors 10 (Refer to FIG. 2).

Since the ring-like urging portions 34, 36 are arranged asymmetrically left and right while the ring-like urging portion 34 on the outer side of the transfer path is located near to the center of the roller 20, and the center b (Refer to FIG. 4B) of the urging force of the ring-like urging portions 34, 36 for urging the roller sheathing 21 is located inward of the transfer path from the center c (FIG. 4B) of the load center biasing roller 20.

Accordingly, when the banknote 5 overlaps with the load center biasing replaceable roller 20 not by the overall length of the latter but by about a half thereof, the center of the urging force is located on the center side of the transfer path where the banknote 2 overlaps with the roller, and therefore, it is possible to prevent the load center biasing replaceable roller 20 from excessively slanting, thereby it is possible to appropriately detect the banknote and foreign matter by the sensors 10 (Refer to FIG. 2).

Figure 5A:
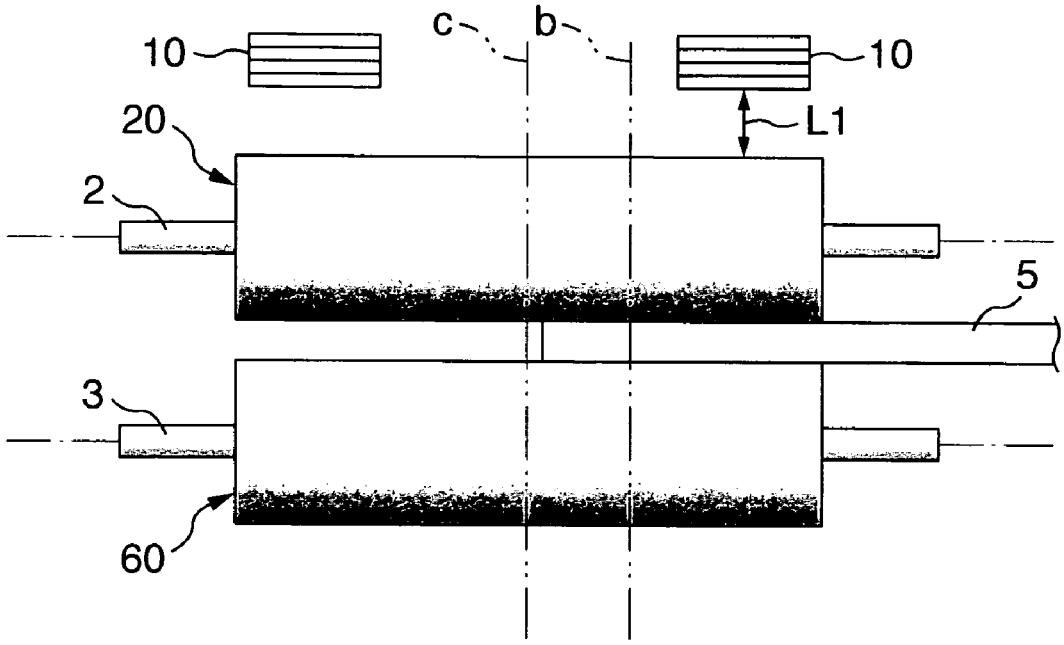
FIGS. 5A and 5B are views for explaining a displaced condition of the load center biasing displaceable roller.

In detail, as shown in FIG. 5A which is a front view, if the banknote 5 overlaps with the load center biasing displaceable roller 20, the load center biasing displaceable roller 20 is raised in parallel since the center b of the urging force by the ring-like urging portions 34, 36 is biased inward of the transfer path (on the banknote 5 side) from the center c of the load center biasing displaceable roller 20.

Thus, the distance L1 between the sensor 10 and the load center biasing displaceable roller 20 is changed by the thickness of the banknote 5, and accordingly, a suitable determining means (such as a control means composed of, for example, CPU, ROM and RAM) may determines the presence of the banknote 5. Accordingly, thereby it is possible to prevent occurrence of such erroneous detection that the load center displaceable roller slants so as to detect the presence of foreign matter as has been conventionally happened.

Figure 5B:
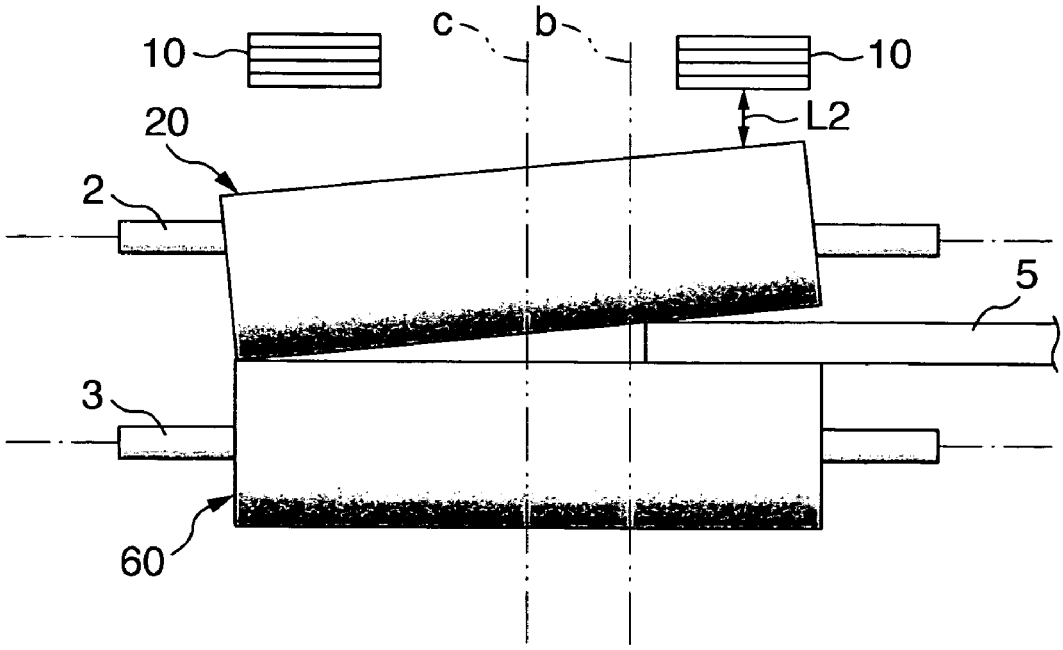

As shown in FIG. 5B which is a front view, in such a case that the banknote 5 overlaps with the load center biasing displaceable roller 20 only outside of the center b of the urging force by the ring-like urging portions 34, 36 within the transfer path, the load center biasing displaceable roller 20 slants.

However, since this slant is small in comparison with the conventional one, a variation in the distance L2 between the sensor 10 and the load center biasing displaceable roller 20 is approximately equal to the banknote 5. Thus, the presence of the banknote may be determined by a suitable determination means.

Thus, with the configuration for restraining the one-side lift-up of the load center biasing displaceable roller 20, although two sensors 10 per load center biasing displaceable roller 20 are provided, it is possible to prevent such erroneous detection that foreign matter is present due to one-side lift-up even though no foreign matter is present.

Figure 6:
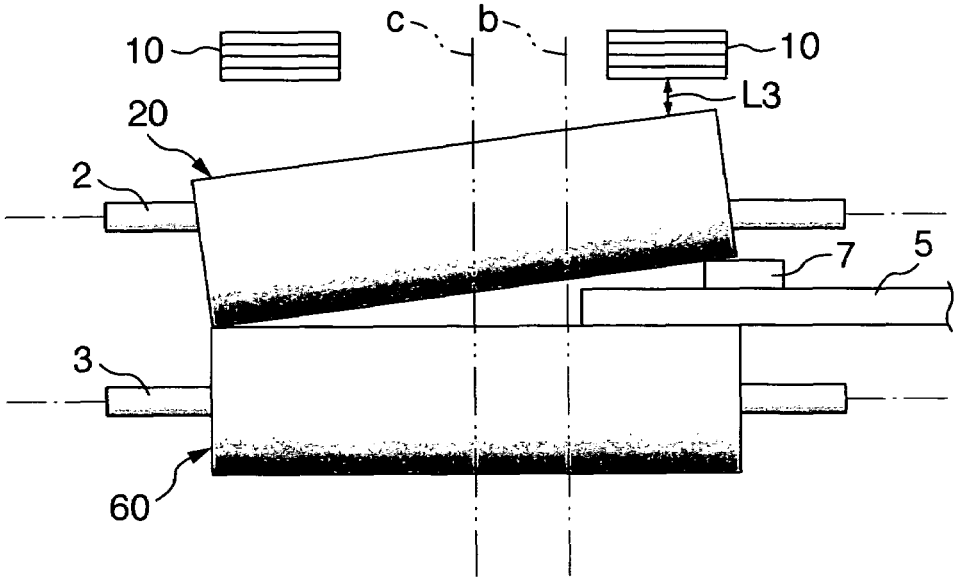
FIG. 6 is a view for explaining a displaced condition of the load center biasing displaceable roller.

If foreign matter sticks to the banknote 10 in the above-mentioned position, as shown in FIG. 6 which is a front view, a variation in the distance L3 between the sensor 10 and the load center biasing displaceable roller 20 becomes larger than a variation in the distance 12 in the case of no presence of foreign matter 7.

Thus, the presence of the foreign matter may be detected by a suitable determination means. With this configuration, there may be detected the foreign matter 7 even having a thickness which is apparently absorbed by the above-mentioned one-side lift-up since the foreign matter 7 sticks to an end part of the banknote 5.

Further, if the load center biasing displaceable roller slants as stated above, it slants since the ring-like urging portion 34 near the center (Refer to FIG. 4B) slants maximumly, but whenever it slants exceeding a predetermined value, the deflection ring portion 31 (Refer to FIG. 4B) makes contact with the inner surface of the roller sheathing 21.

Thus, when the banknote 5 is transferred at a high speed, it overlaps with the load center biasing displaceable roller 20 so that the load center biasing displaceable roller 20 stays slanting, it is possible to prevent occurrence of such a matter that the load center biasing displaceable roller 20 leaps so as to slant by a degree which exceeds the sum of the thicknesses of the banknote 5 and the foreign matter 7, and also to prevent deflection upon tilt rotation and horizontal rotation of the load center biasing displaceable roller 20.

As stated above, with the configuration that the load center biasing rollers 20 each having the load center shifted toward the center of the transfer path, are arranged on the left and right side of the center displaceable roller 40 at the center, and the displaceable rollers may be displaced, independent from one another, the presence of the foreign matter 7 may be precisely detected, thereby it is possible to enhance the accuracy of detection of the thickness of the banknote 5.

Further, foreign matter may be detected over the entire area of the banknote 5, and further, concavities and convexities which are present in an end part of the banknote 5 may also be detected. Further, the thickness detecting apparatus may be small-sized and compact.

If the number of the displaceable rollers 20, 40 arranged transversely is even, only the load center biasing displaceable rollers 20 may be arranged without the center displaceable roller 40.

Further, in such a case that the banknote 5 surely overlaps with a plurality of the displaceable rollers over their overall lengths when the banknote 5 passes thereby, the center displaceable roller 40 may be used for each of these rollers while the load center biasing rollers 20 may be used only for the remaining rollers.

Figure 7A:
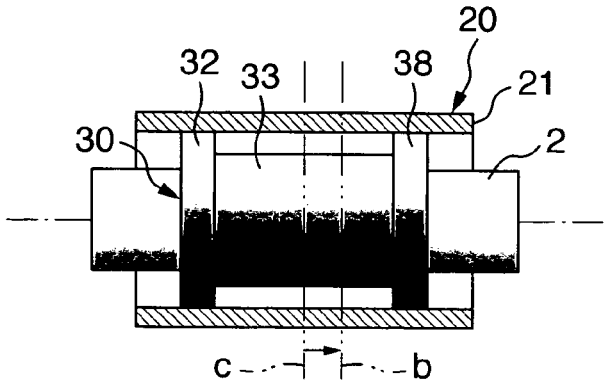
FIGS. 7A to 7C are view for explaining a load center biasing displaceable roller in another embodiment of the present invention.

Further, as shown in FIG. 7A which is a front view, the load center biasing rollers 20 may be formed of different rubber materials.

In this case, it is preferable to arrange the ring-like urging portion 32 of the body portion 33 which is made of a rubber material having a weak urging force on the outer end side of the transfer part, and to arrange the ring-like urging portion 38 which is made of a rubber material having a strong urging force on the inward side of the transfer path.

Figure 7B:
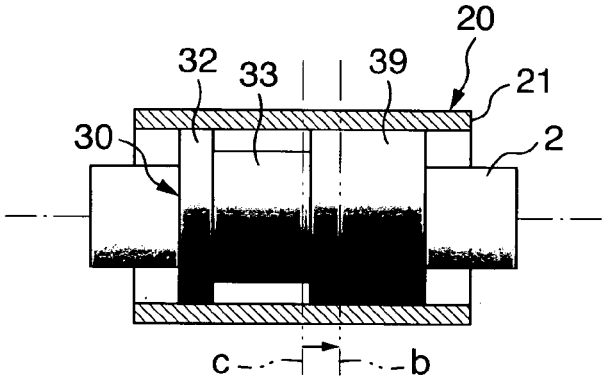

As shown in FIG. 7B which is a front view, the plurality of the ring-like urging portions may have thicknesses which are not uniform, and accordingly, the areas through which the ring-like urging portions are made into the inner surface of the roller sheathing 21 may be ununiform.

In this case, it is preferable to arrange the ring-like urging portion 32 of the body portion 33 having a smaller thickness on the outer end side of the transfer path and to arrange the ring-like urging portion 33 having a larger thickness of the body portion 33 on the inward side of the transfer path.

Figure 7C:
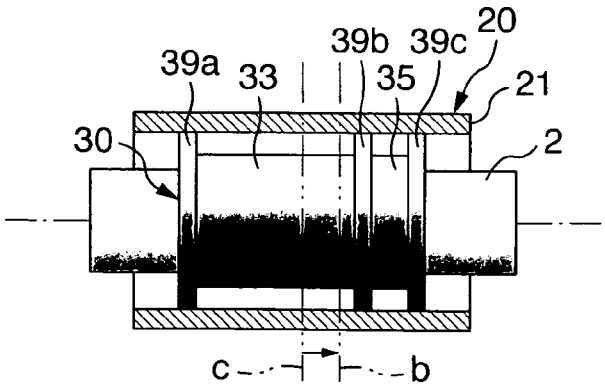
Figure 9:
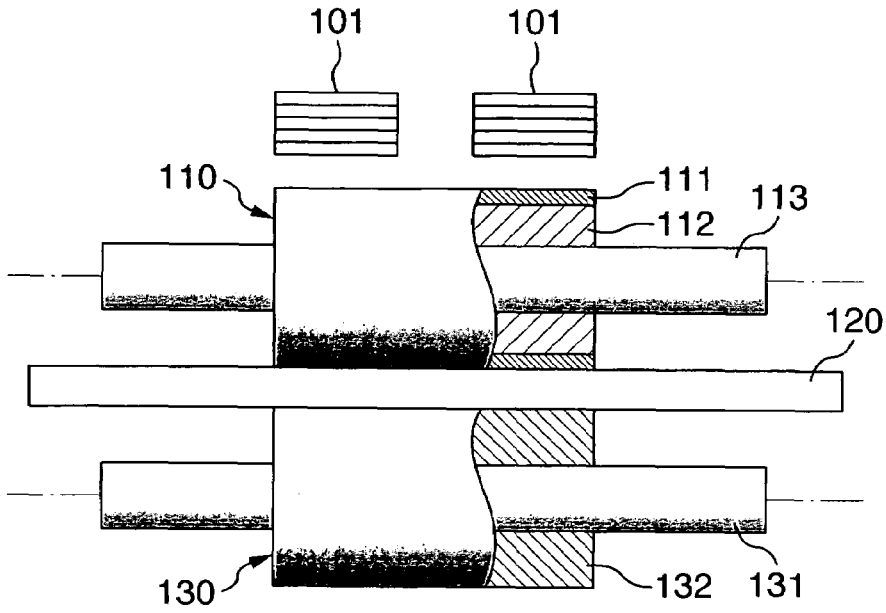
FIG. 9 is a front view illustrating a conventional thickness detecting apparatus.
Figure 13:
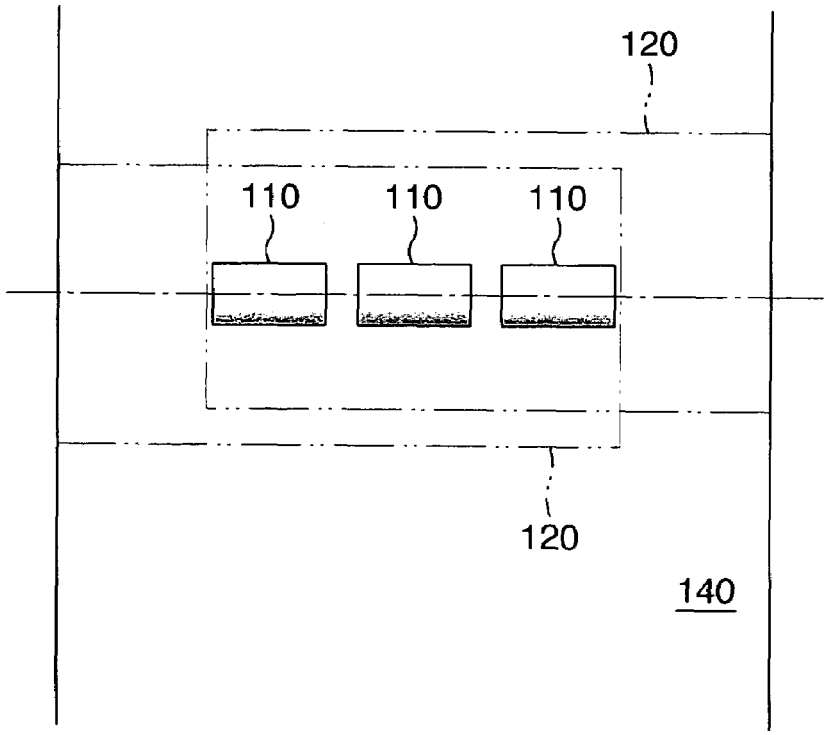
FIG. 13 is a plan view illustrating the conventional thickness detecting apparatus.
Figure 10A:
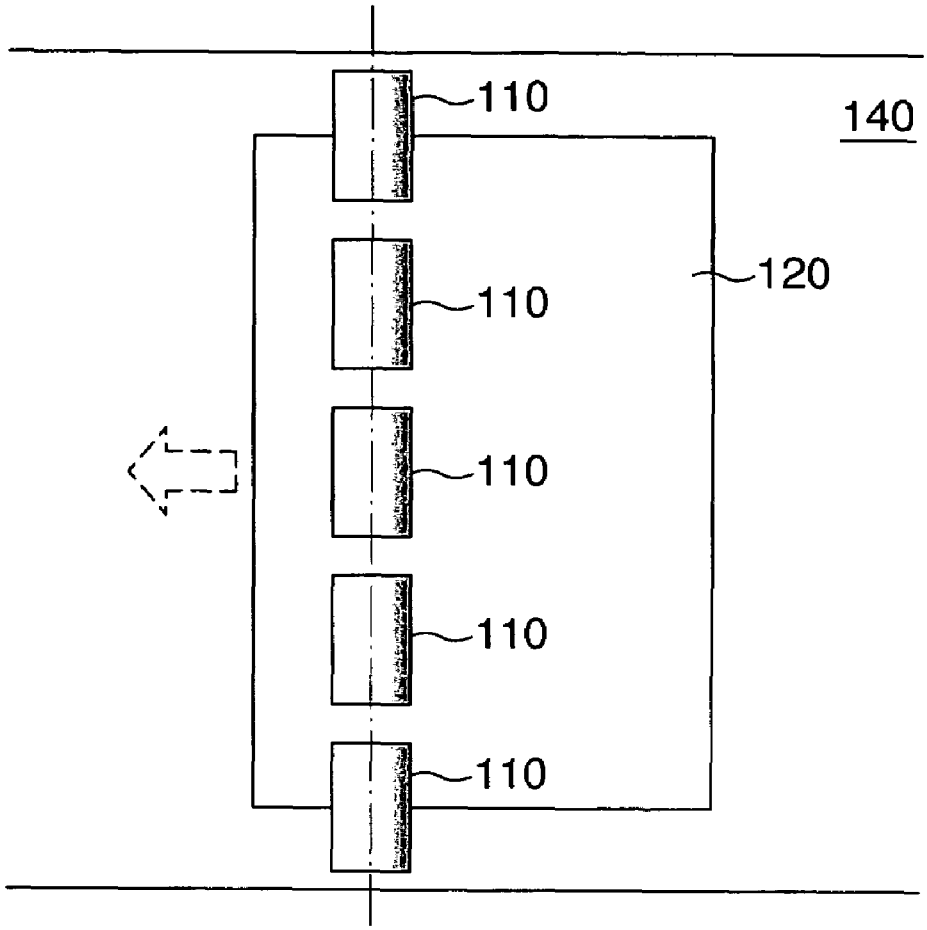
FIGS. 10A and 10B are views for explaining an entire configuration of the conventional thickness detecting apparatus.
Figure 10B:
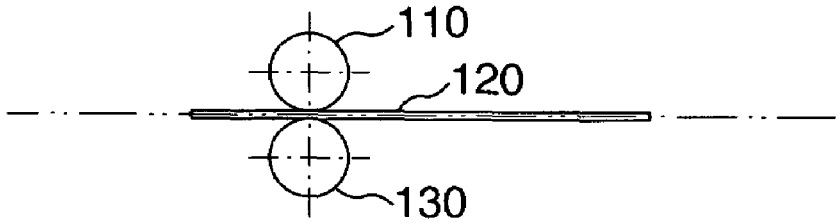
Figure 11A:
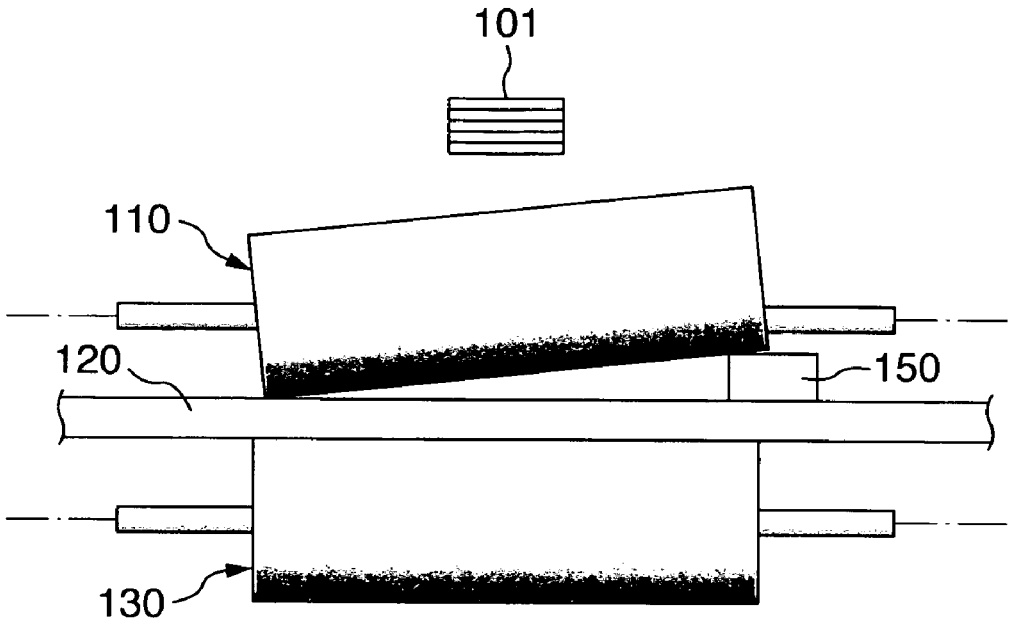
FIGS. 11A and 11B are views for explaining a displaced condition of a conventional displaceable roller.
Figure 11B:
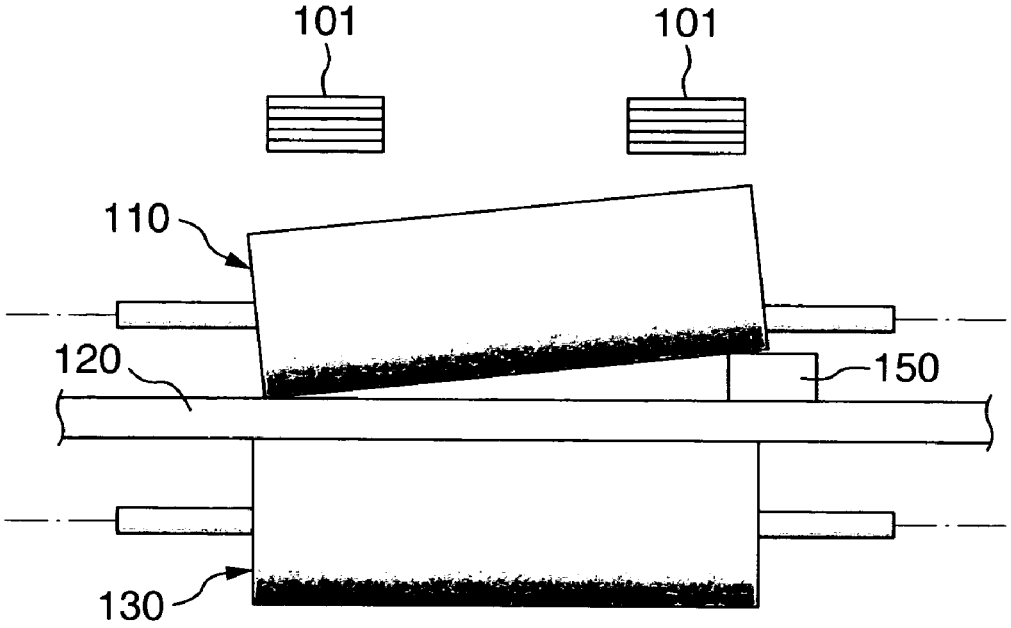
Figure 12A:
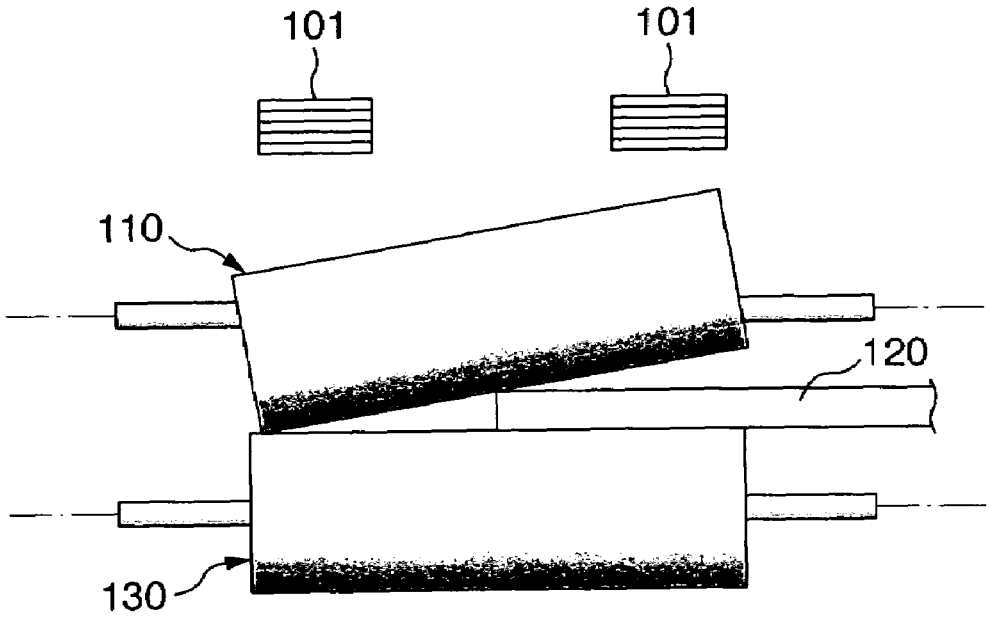
FIGS. 12A and 12B are views for a displaced condition of the conventional displaceable roller.
Figure 12B:
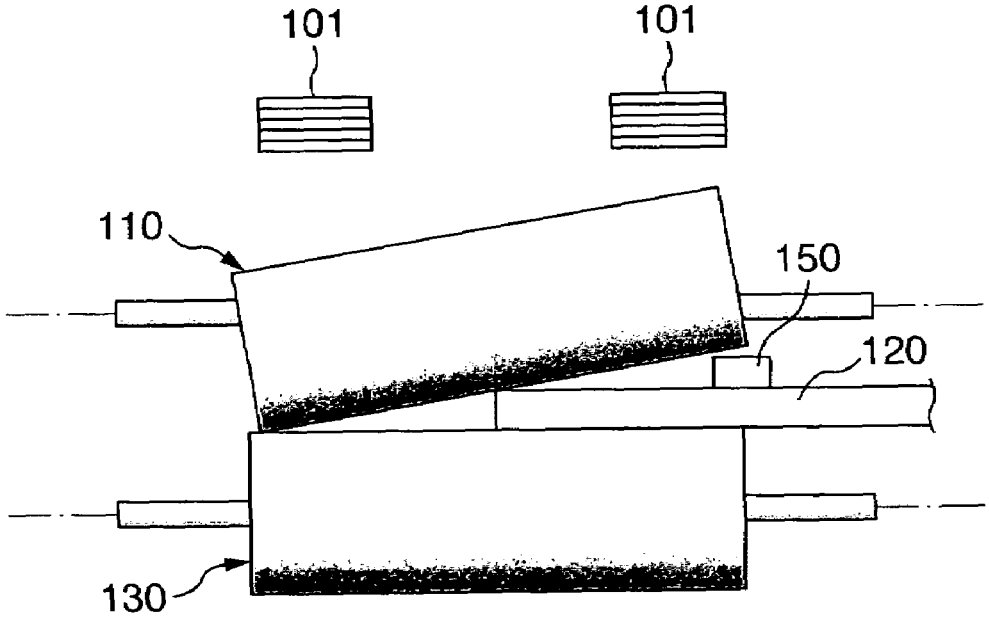

Further, as shown in FIG. 7C which is a front view, a plurality of ring-like urging portions having an equal thickness may be arranged so as to be asymmetric left and right in numbers.

In this case, ring-like urging portions 39*a*, 39*c* may be incorporated to both ends of the body portions 33, 35, and a ring-like urging portion 39*b* may be incorporated inward thereof on the center side of the transfer path.

With this configuration, even though the elastic body 30 has any of various shapes, as stated above, it is possible to enhance the accuracy of detection of a thickness of the banknote 5 by biasing the center of the urging force toward one side.

Further, the body portions 33, 35 and the ring-like urging portions 31, 34, 39, 39*a*, 39*b*, 39*c* may not be integrally incorporated with one another, but they may be separately prepared and connected with one another before they are introduced in to the roller sheathing 21.

Figure 8:
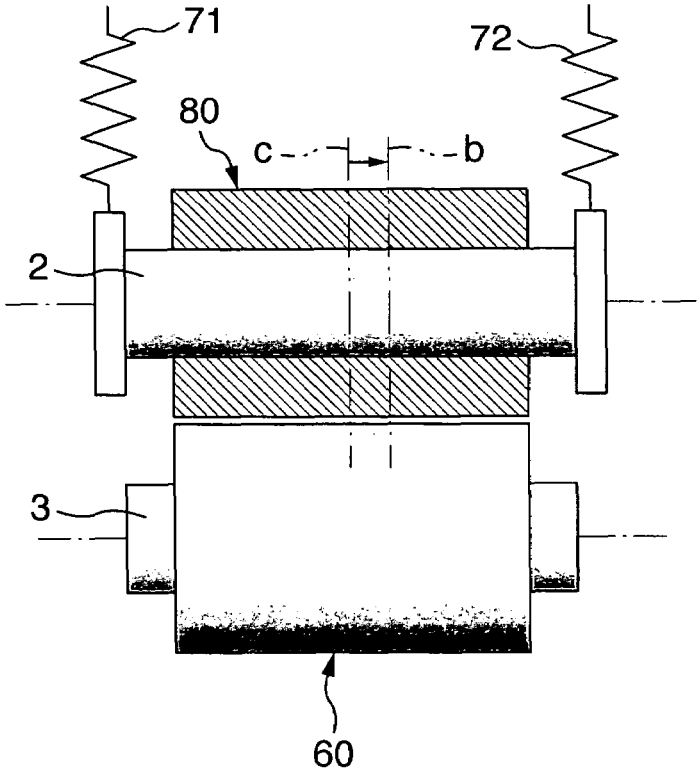
FIG. 8 is a view for explaining a load center biasing roller in another embodiment of the present invention.

Further, as shown in FIG. 8, another type of a load center biasing displaceable roller 80 with no internal components may be used, instead of the load center biasing displaceable roller 20 while a rotary shaft 80 of the load center biasing displaceable roller 80 is urged toward a stationary roller 60 at its opposite ends by springs 71, 72 as resilient members.

In this case, it is preferable to use, on the center side of the transfer path, the spring 72 having a resilient force which is larger than that of the spring 71 on the outer side of the transfer path.

With this configuration, similar to the above-mentioned embodiments, it is possible to enhance the accuracy of the detection of a thickness of a banknote 5.

Further, explanation has been made of such a configuration that the stationary rollers 60 are provided by a number corresponding to the displaceable rollers 20, 80 and the center displaceable roller 40, a long single stationary roller may be used, to which the incorporated load center biasing displaceable rollers 20, 80 and the center displaceable roller are opposed.

In view of the configuration of the present invention with respect to the above-mentioned embodiments:

The core shaft in the present invention correspond to the core shaft 2 in the embodiments, and similarly, the sheet or the like to the banknote 5; the position displaceable rotary body to the load center biasing displaceable roller 20, 80; the sheathing to the roller sheathing 21; the displacement restraining portions to the ring-like deflection preventing portion 31; the elastic member to the elastic body 30; the ring-like portion to the ring-like urging portion 32, 34, 39, 39*a*, 39*b*, 39*c*; a member having a strong resilient force to the ring-like urging portion 38; the stationary rotary body to the stationary roller 60; the displacement to the distance L1, L2, L3; and the load center and the center of urging force to the center b.

However, it is noted that the present invention should not be limited only to the above-mentioned embodiments, but the present invention may include other various embodiments.

The invention claimed is:

1. A thickness detecting apparatus comprising a cylindrical stationary rotary body and a cylindrical displaceable rotary body which are opposed to each other, for detecting a thickness of a sheet or the like, depending upon a displacement by which the displaceable rotary body displaces away from the stationary rotary body when the sheet or the like to be transferred passes through between both stationary rotary body and displaceable rotary body, wherein a center of a load caused when the displaceable rotary body presses the sheet or the like is biased from a center of the displaceable rotary body in one of center axial directions, wherein the displaceable rotary body is composed of a cylindrical sheathing formed of an undeformable member, a core shaft therein and an elastic member interposed between the sheathing and the core shaft, a center of an urging force for urging the inner surface of the sheathing is biased in one of the center axial directions from a center of the displaceable rotary body so as to bias the center of the load, and wherein the elastic member is composed of plural kinds of members having different resilient forces, those of which have strong resilient forces being biased in one of the center axial directions.

2. A thickness detecting apparatus comprising a cylindrical stationary rotary body and a cylindrical displaceable rotary body which are opposed to each other, for detecting a thickness of a sheet or the like, depending upon a displacement by which the displaceable rotary body displaces away from the stationary rotary body when the sheet or the like to be transferred passes through between both stationary rotary body and displaceable rotary body, wherein a center of a load caused when the displaceable rotary body presses the sheet or the like is biased from a center of the displaceable rotary body in one of center axial directions, wherein the displaceable rotary body is composed of a cylindrical sheathing formed of an undeformable member, a core shaft therein and an elastic member interposed between the sheathing and the core shaft, a center of an urging force for urging the inner surface of the sheathing is biased in one of the center axial directions from a center of the displaceable rotary body so as to bias the center of the load, and, wherein the elastic member is composed of a plurality of ring-like parts which make contact with the inner surface of the sheathing in a ring-like manner, and which are ununiformly arranged in the center axial direction.

3. A thickness detecting apparatus comprising a cylindrical stationary rotary body and a cylindrical displaceable rotary body which are opposed to each other, for detecting a thickness of a sheet or the like, depending upon a displacement by which the displaceable rotary body displaces away from the stationary rotary body when the sheet or the like to be transferred passes through between both stationary rotary body and displaceable rotary body, wherein a center of a load caused when the displaceable rotary body presses the sheet or the like is biased from a center of the displaceable rotary body in one of center axial directions, wherein the displaceable rotary body is composed of a cylindrical sheathing formed of an undeformable member, a core shaft therein and an elastic member interposed between the sheathing and the core shaft, a center of an urging force for urging the inner surface of the sheathing is biased in one of the center axial directions from a center of the displaceable rotary body so as to bias the center of the load, and wherein the elastic member is formed so that a displacement restraining member for restraining excessive displacement is incorporated to one end part of the elastic member on the side where the urging force in the axial direction is weaker.

* * * * *